US005514001A

United States Patent [19]

Szegda

[11] Patent Number: 5,514,001

[45] Date of Patent: May 7, 1996

[54] SECURITY COAXIAL CONNECTOR

[75] Inventor: Andrew Szegda, Canastota, N.Y.

[73] Assignee: John Mezzanlingua Assoc. Inc., Manilus, N.Y.

[21] Appl. No.: 236,418

[22] Filed: Apr. 29, 1994

[51] Int. Cl.[6] ..... H01R 13/193

[52] U.S. Cl. ..... 439/263; 439/259

[58] Field of Search ..... 439/133, 259, 439/263, 264, 578–585, 848

[56] References Cited

U.S. PATENT DOCUMENTS

| | | | |
|---|---|---|---|
| 2,205,186 | 6/1940 | Andre | 439/221 |
| 2,269,314 | 1/1942 | MacDonald | 439/848 |
| 2,498,589 | 2/1950 | Steinke | 439/322 |
| 3,275,970 | 9/1966 | Johanson et al. | 439/578 |
| 3,308,416 | 3/1967 | Boyd | 439/115 |
| 3,525,973 | 8/1970 | Kipnes | 439/578 |
| 3,845,453 | 10/1974 | Hemmer | 439/578 |
| 4,346,958 | 8/1982 | Blanchard | 439/584 |
| 4,781,611 | 11/1988 | Leonard | 439/259 |
| 5,073,129 | 12/1991 | Szegda | 439/585 |
| 5,183,412 | 2/1993 | Nagafuji | 439/578 |
| 5,195,906 | 3/1993 | Szegda | 439/394 |

*Primary Examiner*—Neil Abrams

*Attorney, Agent, or Firm*—Samuels, Gauthier, Stevens & Reppert

[57] ABSTRACT

The connector of the invention is particularly suited for use in combination with a coaxial cable and an equipment port having an internal first conductor. The end connector of the invention includes a connector element, a deflecting unit and a component interlocking unit. The connector element has one end adapted to be secured to the coaxial cable and includes a tubular connector wall at an opposite end surrounding a second electrical conductor. The connector wall is configured and dimensioned to axially receive a tubular port wall therein, with the first and second conductors being normally spaced one from the other. The deflecting unit is responsive to axial reception of the port wall in the connector wall for deflecting one of the conductors into electrical contact with the other of the conductors. The interlocking unit is associated with the port and connector walls for establishing an interlocked relationship between the equipment port and the connector element.

15 Claims, 3 Drawing Sheets

SECURITY COAXIAL CONNECTOR

BACKGROUND OF THE INVENTION

The invention relates to end connectors used to connect cables to equipment ports, terminals or the like, as well as to connectors used to connect two cables together in series. The invention is particularly useful in, although not limited to, end connectors for coaxial cables in the cable television industry.

A conventional coaxial cable usually consists of a centrally located inner electrical conductor surrounded by and spaced inwardly from an outer electrical conductor. A dielectric insulator is interposed between the inner and outer conductors, with the outer conductor being surrounded by a dielectric jacket. The outer conductor can comprise a sheath of fine braided metallic strands, a metallic foil, or multiple layer combinations of either or both.

A conventional end connector is generally tubular shaped having a front end which is adapted to attach to equipment ports or terminals, and a rear end which is adapted to receive and attach to the cable. Examples of such end connectors are described in U.S. Pat. Nos. 4,990,106; 5,073,129; and 5,195,906 each of which is assigned to the assignee of interest of the present invention, and each of which is herein incorporated by reference.

A conventional end connector port is typically adapted to receive the front end of the connector as well as the centrally located inner conductor of the coaxial cable which passes through the end connector.

Conventional end connectors and ports are not presently designed to prevent unauthorized access in certain situations. For example, although an end connector and cable may be disconnected from a cable television equipment port by an authorized service person upon termination of a subscription, the consumer may readily obtain a substitute end connector and cable at a local electronics store and reconnect the signal thus gaining unauthorized access to the cable service. There is a need for a security coaxial connector that prevents such unauthorized access.

Also, as the communications industry prepares to provide a broad range of multi-media services, there is an interest in providing such services through presently available hardware including conventional end connectors. Because such connectors are generally interchangeable however, there is a risk that incorrect connections may be made thereby possibly damaging equipment. There is a need, therefore, for easily identifying different types of ports and readily correlating them with the appropriate end connectors.

Moreover, there is a need to provide such security and/or identification means for presently existing coaxial systems at a minimal modification cost.

SUMMARY OF THE INVENTION

The connector of the present invention is particularly suited for use in combination with a coaxial cable system component having a tubular shaped port wall surrounding a first conductor, and a coaxial cable having an axially protruding second conductor. The connector is employed to couple the coaxial cable to the system component, such as a cable television signal receiving unit.

The end connector of the invention includes a deflecting member and a component interlocking means. The end connector has one end adapted to be secured to the cable and a tubular shaped connector wall at an opposite end surrounding the second conductor. The connector wall is configured and dimensioned to axially receive the port wall therein, with the first and second conductors being normally spaced one from the other. The deflection member is responsive to axial reception of the port wall in the connector wall for deflecting one of the conductors into electrical contact with the other of the conductors. The interlocking means is associated with the port and connector walls for establishing an interlocked relationship between the system component and the connector element.

BRIEF DESCRIPTION OF THE DRAWINGS

The following detailed description may be further understood with reference to the accompanying drawings in which.

DETAILED DESCRIPTION OF THE ILLUSTRATED EMBODIMENTS

Figure 1:
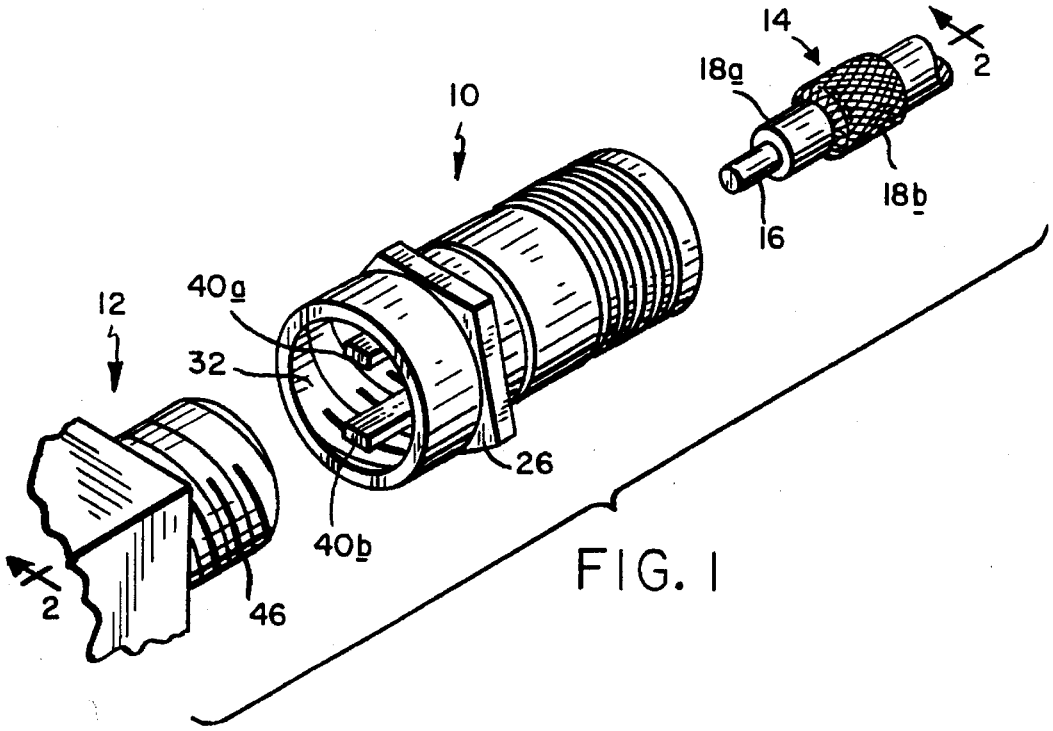
FIG. 1 is an exploded perspective view showing an equipment port and an end connector in accordance with the present invention, as well as an end of a typical coaxial cable that has been prepared for insertion into the end connector.
Figure 2:
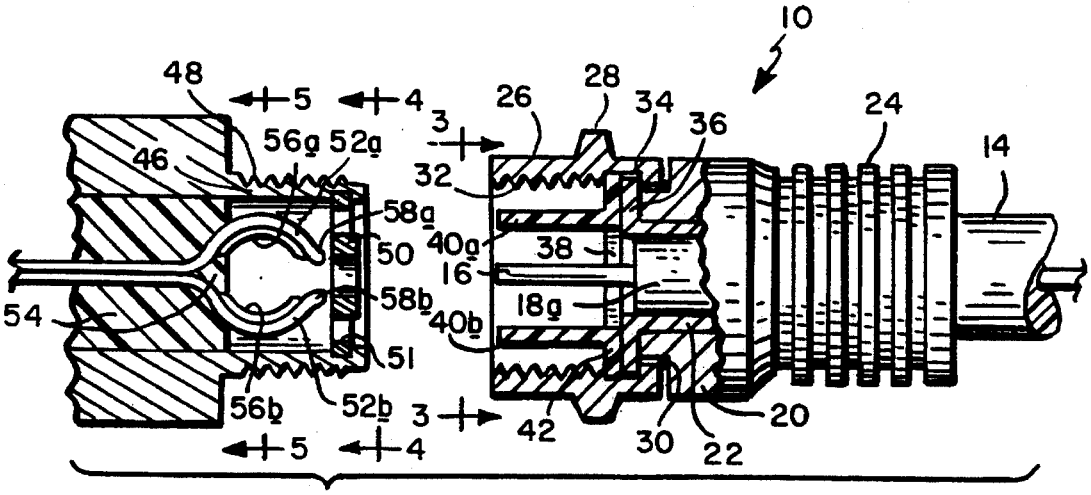
FIG. 2 is a sectional view on an enlarged scale taken along line 2—2 of FIG. 1 with the cable received within the crimped end connector.
Figure 3:
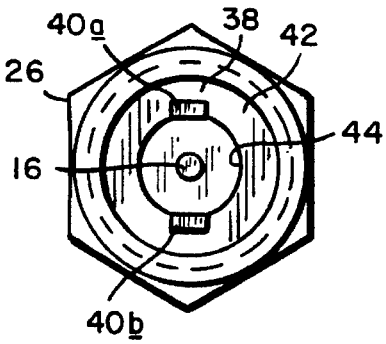
FIGS. 3–5 are views taken along lines 3—3, 4—4 and 5—5 respectively of FIG. 2.
Figure 4:
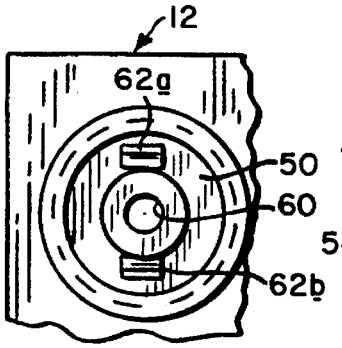
Figure 5:
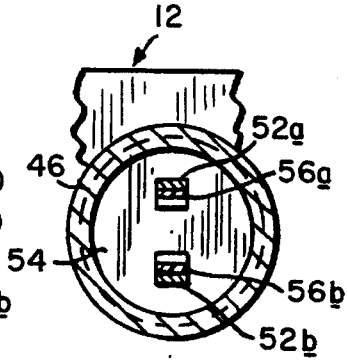

With reference initially to FIGS. 1–6, an end connector 10 is shown between an externally threaded equipment port 12 and a conventional coaxial cable 14 that has been prepared for receipt within the end connectors 10 in accordance with the procedures described in U.S. Pat. Nos. 4,990,106; 5,073,129; and 5,195,906.

The end connector 10 may securely receive the coaxial cable by various means whereby the centrally located inner electrical conductor 16 passes into and through the end connector 10. For example, as described in U.S. Pat. Nos. 4,990,106 and 5,073,129, the outer electrical conductor may include a metallic foil **18*a* and a braided metallic sheath 18*b*, and the connector 10 may include a tubular body 20 and an internal post 22 (partially shown in FIG. 2). The outer electrical conductor is engaged in electrical communication (not shown) with the tubular body 20 and the internal post 22 by receiving the post 22 between the metallic foil 18*a* and the metallic sheath 18*b* as described in U.S. Pat. Nos. 4,990,106 and 5,073,129. The rear end portion 24 of the end connector 10** is thereafter crimped with an appropriate tool to secure engagement.

As shown in FIGS. 1–6 the end connector 10 further includes a fastener 26 rotatably received on the front end 28 of the end connector 10, and an o-ring 30 interposed between the tubular body 20 and the fastener 26. The fastener is internally threaded as at 32 and is provided with a fastener flange 34 arranged to coact in mechanical interengagement with a post flange 36 on the post 22.

The end connector 10 further includes an actuator element 38 having parallel prongs 40*a*, 40*b* projecting axially from a circular base 42 having a centrally located circular opening 44. The actuator element 38 is made of a dielectric material, preferably stiff plastic, and may be easily snapped into or threadingly received within the fastener 26. Upon insertion the element 38 is free to rotate within the fastener 26. In alternative embodiments the prongs 40 may be of various shapes having a variety of cross sectional areas (e.g., rectangular, square, circular, etc.).

The externally threaded port 12 includes a tubular wall 46 having external threads 48, a circular front wall 50, and a pair of electrically conductive contact elements 52*a*, 52*b* axially centrally anchored within a dielectric material 54. The contact elements 52*a*, 52*b* each include arcuately shaped portions having coatings of dielectric materials 56*a*, 56*b* on the concave inwardly facing surfaces thereof, and tip portions 58*a*, 58*b*. In alternative embodiments the contact elements may also include coatings of dielectric materials on the concave surfaces thereof. The contact elements 52*a*, 52*b* are joined together at the opposite ends of the arcuately shaped portions within the dielectric material 54 and extend axially through the material 54 for internal connection within the equipment.

The circular front wall 50 is retained within a groove 51 in the wall 46 and includes a centrally located circular opening 60 through which the inner electrical conductor 16 may be received, and a pair of radially oppositely disposed rectangular openings 62*a*, 62*b* through which the prongs 40*a*, 40*b* may be received. The wall 50 is preferably metallic and may include a dielectric collar within the opening 60.

Figure 6:
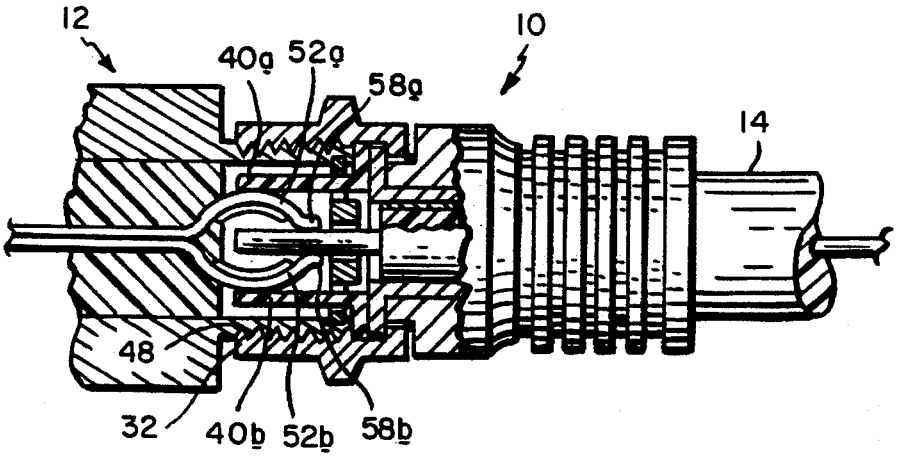
FIG. 6 is a sectional view similar to FIG. 2 but showing the end connector attached to the port.

With reference to FIG. 6, during assembly of the connector 10 to the port 12, the central conductor 16 extends through the opening 60 in the front wall 50 and passes between the contact elements 52*a*, 52*b*. At the same time the prongs 40*a*, 40*b* enter through openings 62*a*, 62*b* and frictionally encounter the convex outer surfaces of the contact elements 52, thereby resiliently urging the contact elements inwardly to bring their tips 58 into electrical contact with the central conductor 16 passing therebetween. In alternative embodiments the prongs 40 may include angled tip portions to facilitate engagement with the contact elements 52. The fastener 26 threadingly engages the externally threaded wall 46 of the port 12 thereby securing physical attachment as well as electrical communication of the outer electrical conductor 18 (typically ground) through the fastener 26 to the port wall 46.

In light of the foregoing, it will be seen that any attempt to couple a conventional end connector to port 12 will result in a failure to make electrical contact between the central conductor 16 and the tips 58 of the contact elements 52 because the latter will remain spread apart and spared from the axial path of the central conductor 16. Likewise, any attempt to insert a conductor through the circular opening 60 will fail due to the dielectric coatings 56 on the contact elements 52, as well as the presence of the axially centrally located portion of the dielectric material 54. Attempts to insert a conductor through the rectangular openings 62*a*, 62*b* will also fail due to the fact that an electrical short would result if the conductor 16 contacts either of the front wall 50 or the interior surface of the tubular wall 46. As a further precaution, the contact elements may also include a coating of a dielectric material on their radially outwardly facing surfaces.

Figure 7:
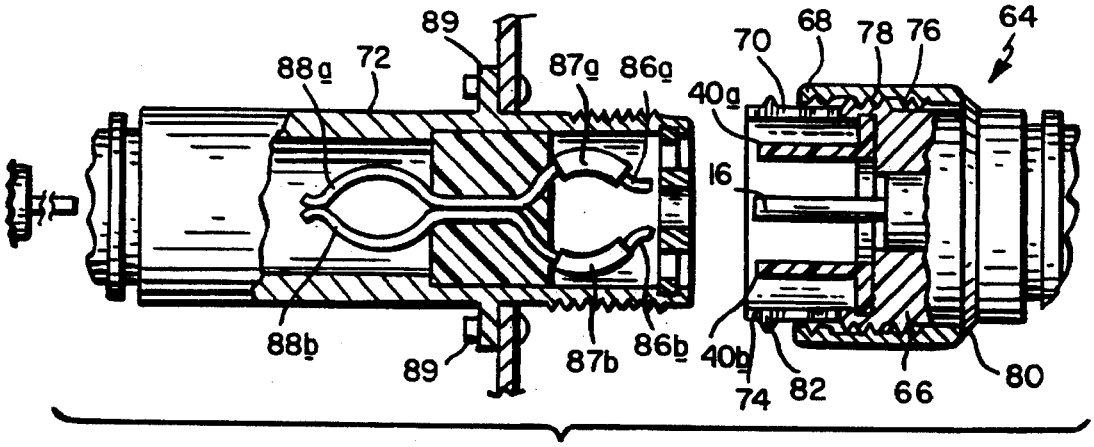
FIG. 7 is a longitudinal sectional view of an alternative embodiment of the invention.
Figure 8:
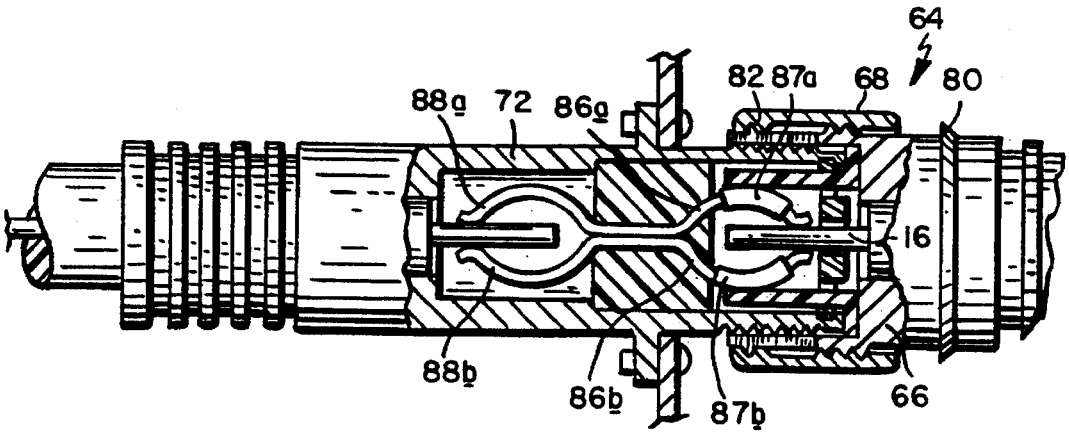
FIG. 8 is a sectional view similar to FIG. 7 with the end connector attached to the port.

As shown in FIGS. 7 and 8 an alternative embodiment of the invention includes an end connector 64 having a tubular body 66 and an external locking sheath 68 on the front end thereof as described in U.S. Pat. No. 5,195,906. In particular, the front end of the tubular body 66 includes a split ferrule 70 adapted for axial attachment to a port 72. The split ferrule 70 includes a plurality of axially extending longitudinal slits on the front end of the body 66 that define a plurality of resilient fingers 74.

The locking sheath 68 is configured with an interior threaded surface 76 that is threadingly engaged with a threaded portion 78 provided on the outer surface of the body 66. The locking sheath 68 may be axially displaced from an unlocked position in which it abuts stop member 80 as illustrated in FIG. 7 to a locked position as illustrated in FIG. 8. The locked position is obtained by rotating the sheath 68 over the ferrule 70 until an interior circumferential locking channel 82 grasps an outwardly projected circumferential locking ring 84 that is defined by outwardly arcuate projections disposed on each of the resilient fingers 74 on the ferrule 70. When the sheath 68 is in the locked position as illustrated in FIG. 8, an inwardly directed force applies a radial pressure to the fingers 74 of the ferrule 70 so as to enhance the grasping pressure on the port 72. The port 72 may include external threads to further secure attachment of the conductor 64 by increasing the surface to surface contact pressure as between the components.

As also shown in FIGS. 7 and 8, the end connector port 72 includes contact elements having arcuately shaped portions 86*a*, 86*b* and 88*a*, 88*b* on either end. The arcuately shaped portions 86 include a dielectric sleeve 87*a*, 87*b* on portions thereof, and are designed to engage the inner conductor 16 responsive to the urging of the prongs 40 as discussed above. The arcuately shaped portions 88 are internal to the equipment port and provide for convenient connection to an internal cable as illustrated in FIGS. 7 and 8 without the need for an actuator element. The port 72 may also include a radial shoulder 89 for attachment to a wall in an equipment unit such as a cable television receiving unit as shown in FIGS. 7 and 8. The port 72 may therefore be easily substituted for existing equipment ports with a minimal amount of required servicing.

Figure 9:
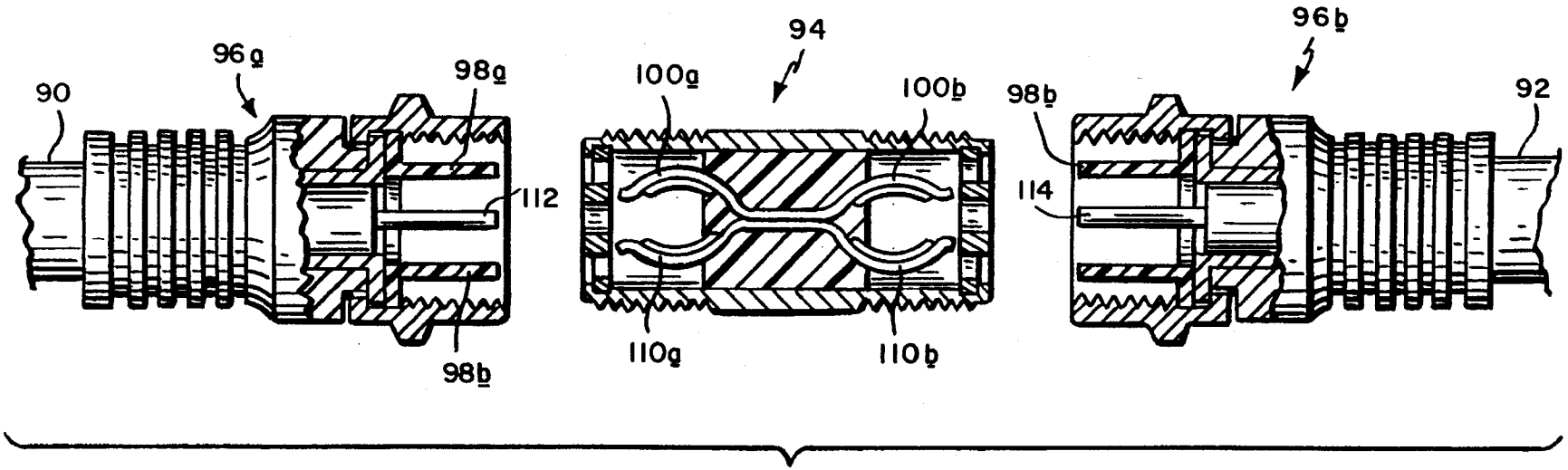
FIG. 9 is a longitudinal exploded sectional view of another embodiment of the invention wherein two coaxial cables are connected together in series using two connectors and a coupling unit.

As shown in FIG. 9 the invention may be employed in yet another embodiment to join two coaxial cables 90, 92 together in series using a coupling unit 94 between two connectors 96*a*, 96*b*. The actuator elements 98*a*, 98*b* of the connectors 96 coact with the coupling unit 94 to engage inner conductors 100*a*, 110*a* at one end and 100*b*, 110*b* at the other end of the unit 94 in accordance with the procedures described above with reference to the previous embodiments to establish electrical communication between each of the respective inner conductors 112, 114 and outer conductors of the coaxial cables through the coupling unit 94.

It will be appreciated by those skilled in the art that various modifications and variations may be made to the above described embodiments without departing from the spirit or scope of the invention.

I claim:

1. For use in combination with a coaxial cable system component having a tubular first wall surrounding a first conductor, and a coaxial cable having an axially protruding second conductor, an end connector for mechanically coupling said cable to said system component and for establishing an electrical connection between said first and second conductors, said end connector comprising:

a connector element having a first end adapted to be secured to said cable and having an open-ended tubular second wall at an opposite second end surrounding said second conductor, said second wall being configured and dimensioned to axially receive said first wall therein, with said first and second conductors being normally spaced one from the other, said second wall being freely rotatable with respect to said first end;

deflecting means associated with and freely rotatable with respect to said second wall responsive to axial reception of said first wall in said second wall for directly contacting said first conductor and deflecting said first conductor into electrical contact with said second conductor; and connecting means associated with said second wall for establishing an interlocked relationship with said first wall, wherein said coaxial cable system component further includes a front wall retained within said tubular first wall, said front wall having at least one opening therethrough for receiving both said second conductor and said deflecting means.

2. An end connector as claimed in claim 1, wherein said first conductor includes a bifurcated portion within said first wall, said bifurcated portion having two conductive members that are normally spread one from the other and that are deflected into electrical contact with said second conductor by said deflecting means upon receipt of said first wall in said second wall.

3. An end connector as claimed in claim 2, wherein said deflecting means includes two deflecting members each for deflecting one of said conductive members into electrical contact with said second conductor upon receipt of said first wall in said second wall.

4. An end connector as claimed in claim 3, wherein each of said conductive members is arcuately shaped and radially oppositely disposed such that the concave portions of said conductive members face one another.

5. An end connector as claimed in claim 3, wherein each of said conductive members includes a dielectric material on a portion of its radially inwardly facing surface.

6. An end connector as claimed in claim 1, wherein said connector means includes an exteriorly threaded portion on said first wall and an internally threaded portion on said second wall configured to receive said exteriorly threaded portion on said first wall.

7. An end connector as claimed in claim 1, wherein said connector means includes an exteriorly threaded portion on said second wall, and an external locking element on said second wall rotatably engageable with said threaded portion of said second wall following insertion of said first wall into said second wall.

8. An end connector assembly for connecting a coaxial cable to a port, said end connector assembly comprising:

a generally tubular shaped connector including port attachment means at a front end portion of said connector for attaching said connector to said port, and cable attachment means at a rear end portion of said connector for attaching said connector to said coaxial cable, said port attachment means being freely rotatable with respect to said cable attachment means; and receiving means associated with said port for receiving an inner electrical conductor of said coaxial cable through said connector, said receiving means including at least one radially displaceable contact member;

said connector further including displacing means associated with and freely rotatable with respect to said front end portion of said connector and adapted for receipt within said port, said displacing means being responsive to receipt of said port within said connector for directly contacting said contact member and displacing said contact member from an open position in which said contact member is not in electrical communication with said inner electrical conductor, to a closed position in which said contact member is in electrical communication with said inner electrical conductor, wherein said port further including a front wall retained there within, said front wall having at least one opening therethrough for receiving both said inner electrical conductor and said displacing means.

9. An end connector assembly as claimed in claim 1, wherein said receiving means further includes a second radially displaceable contact member that is radially displaced responsive to receipt of said displacing means from an open position in which said second contact member is not in electrical communication with said inner electrical conductor, to a closed position in which said contact member is in electrical communication with said inner electrical conductor.

10. An end connector assembly as claimed in claim 9, wherein said first and second contact members are radially oppositely disposed.

11. An end connector assembly as claimed in claim 8, wherein said radially displaceable contact member includes a dielectric material on a radially inwardly facing surface thereof.

12. An end connector assembly as claimed in claim 8, wherein said displacing means includes at least one displacing element adapted for receipt within said port, said displacing element for engaging said contact member upon attachment of said connector to said port and for urging said contact member to be displaced from said open position to said closed position.

13. An end connector assembly as claimed in claim 8, wherein said radially displaceable contact member of said port is in electrical communication with a bifurcated electrical contact element within said port.

14. A coupling connector assembly for connecting two coaxial cables together in series, said connector assembly comprising:

a first and a second generally tubular shaped connector, each connector including coupling attachment means at the front end portions of said connectors for attaching said connectors to a coupling element, and each including cable attachment means at rear end portions of said connectors for attaching said connectors to first and second coaxial cables respectively, each of said coupling attachment means being freely rotatable with respect to its associated cable attachment means; and first and second receiving means associated with said coupling element for receiving an electrical inner conductor of each of said coaxial cables through said first and second connectors respectively, said receiving means each including at least one radially displaceable contact member;

each of said connectors further including displacing means associated with and freely rotatable with respect to said front end portions of said connectors and each adapted for receipt within said coupling element, each said displacing means being responsive to receipt of said coupling element within each said connector for directly contacting said contact members and displacing said contact members from an open position in which said contact members are not in electrical communication with said electrical inner conductors, to a closed position in which said contact members are in electrical communication with each said respective electrical inner conductor, wherein each of said receiving means of said coupling element further including a front wall retained therein, each of said front walls having at least one opening therethrough for receiving both said electrical inner conductors and said displacing means.

15. A coupling connector assembly as claimed in claim 14, wherein said first and second receiving means each include a bifurcated contact member, and each of said displacing means includes a two pronged displacing member for displacing each of said contact members from said open position to said closed position.

* * * * *